US005794430A

United States Patent [19]

Grecksch et al.

[11] Patent Number: 5,794,430

[45] Date of Patent: Aug. 18, 1998

[54] FIBER CONDUIT PLATE FOR AN OPEN-END SPINNING DEVICE

[75] Inventors: Hans Grecksch, Mönchengladbach; Lothar Winzen, Erkelenz; Brigitte Riede, Mönchengladbach; Wolfgang Radermacher, Wegberg, all of Germany

[73] Assignee: W. Schlafhorst AG & Co., Monchen-Gladbach, Germany

[21] Appl. No.: 847,059

[22] Filed: May 1, 1997

[30] Foreign Application Priority Data

May 2, 1996 [DE] Germany ..... 196 17 527.5

[51] Int. Cl.[6] ..... D01H 4/00

[52] U.S. Cl. ..... 57/417; 57/404; 57/407

[58] Field of Search ..... 57/404, 407, 408, 57/411, 412, 413, 414, 415, 417

[56] References Cited

U.S. PATENT DOCUMENTS

| | | | |
|---|---|---|---|
| 4,712,369 | 12/1987 | Vernon | 57/414 |
| 4,843,812 | 7/1989 | Raasch | 57/414 |
| 5,321,943 | 6/1994 | Schmid et al. | 57/417 |
| 5,638,671 | 6/1997 | Stahlecker et al. | 57/417 |

FOREIGN PATENT DOCUMENTS

| | | |
|---|---|---|
| AS 20 38 689 | 7/1970 | Germany . |
| 43 34 485 A1 | 10/1993 | Germany . |
| 43 42 539 A1 | 12/1993 | Germany . |
| 195 24 837.6 | 7/1995 | Germany . |

*Primary Examiner*—William Stryjewski
*Attorney, Agent, or Firm*—Kennedy Covington Lobdell & Hickman LLP

[57] ABSTRACT

An open-end spinning device with a forwardly open suctioned rotor housing, a high speed spinning rotor rotatably disposed in the rotor housing, and a fiber conduit plate for closing the forward opening in the rotor housing. The fiber conduit plate has an interchangeably disposed conduit plate adapter defining an opening from a fiber guide conduit into the rotor and a yarn take-off nozzle. The conduit plate adapter can be releasably fixed securely in place in a receptacle area of the fiber conduit plate by means of a central fastening arrangement comprising a threaded connection and a magnetic coupling between the fiber conduit plate and the conduit plate adapter.

10 Claims, 3 Drawing Sheets

FIBER CONDUIT PLATE FOR AN OPEN-END SPINNING DEVICE

FIELD OF THE INVENTION

The present invention relates generally to open-end spinning devices and, more particularly, to fiber conduit plates for such open-end spinning devices.

BACKGROUND OF THE INVENTION

Open-end spinning devices commonly have a suctioned rotor housing open at its forward side with a spinning rotor disposed in the rotor housing for rotation at high speed and a fiber conduit plate closing the open forward side of the rotor housing. It is also known to equip the fiber conduit plate of such open-end spinning devices with a conduit plate adapter which defines an opening of a fiber guide conduit and with a yarn take-off nozzle. The conduit plate adapter is disposed to be interchangeable and can be releasably fixed in place by means of an appropriately designed receptacle. Such open-end spinning devices are disclosed, for example, in German Patent Publications DE 43 34 485 A1 and DE-AS 20 38 689.

In such spinning devices, the fiber conduit plate is supported by a pivotably seated cover element which has an annular groove for receiving a lip sealing element and a receptacle which is open in the direction facing the rotor housing and has conical contact surfaces. A cover extension is releasably fixed in this receptacle by means of threaded bolts which pass through corresponding through-bores in the cover element and engage fastening bores of the cover extension. The exact fixation of the cover extension in place in the receptacle, particularly the angularly correct alignment of the cover extension, is accomplished by means of a straight pin inserted into a fitting bore of the cover element to engage another fitting bore correspondingly formed on the reverse side of the cover extension. In the installed state of the cover extension angularly aligned correctly by means of the straight pin, the cover extension rests with its conical contact surface against the correspondingly formed contact surface of the receptacle to apply a holding force acting in the axial direction through the fastening bolts.

This type of fastening in this known spinning device is disadvantageous, however, because a relatively elaborate operation is required to first remove the two machine bolts for exchanging the cover extension. Attempts have therefore already been made to replace this somewhat cumbersome and time-consuming fastening method by employing arresting means which are charged by a spring force.

An open-end spinning device which has a cover element with a fiber conduit plate is described in the later published German Patent Publication DE 195 24 837.6. A conduit plate adapter is fixed in place in the receptacle of the fiber conduit plate by means of a bar spring which is fixed at one end on the fiber conduit plate and engaged in a tangential groove cut into the conical contact surface of the bearing body of the conduit plate adapter. When required, the conduit plate adapter can be removed quickly and without problems by bending the bar spring back.

However, it has been shown in actual use that such a fastening method is only conditionally suitable for assuring a dependable seating of the conduit plate adapter which can be easily released when required. For example, an off-centered force during introduction of the conduit plate adapter can lead to tilting of the conical bearing body of the conduit plate adapter in the receptacle of the fiber conduit plate, with the result that problems caused by the inflow of secondary air occur in the spinning device.

A shaftless two-piece spinning rotor for open-end spinning frames is also known from German Patent Publication DE 43 42 539 A1. In this case the two-piece spinning rotors consist of a spinning cup receiving the yarn to be spun and a drive and bearing element releasably fastened on the spinning cup, which has a number of permanent magnets and constitutes the rotor of an axial field motor.

The drive and bearing element is coupled with the spinning cup via a releasable connection consisting of interlocking elements in the form of a threaded connection and frictionally connected elements in the form of a magnetic coupling.

SUMMARY OF THE INVENTION

Based on the above background, it is an object of the present invention to provide an improved arrangement for open-end spinning devices for fastening conduit plate adapters with respect to the fiber conduit plate of the spinning device.

In accordance with the present invention, this objective is attained by means of an open-end spinning device basically comprising a rotor housing defining a forward opening, a spinning rotor rotatably disposed in the forward opening of the rotor housing for driven rotation, a fiber conduit plate for closing the forward opening of the rotor housing, and a conduit plate adapter having an opening for delivering fibers to the rotor and a nozzle for take-off of yarn from the rotor. According to the present invention, a fastening arrangement releasably affixes the conduit plate adapter centrally with respect to the fiber conduit plate for selective exchangeability of the conduit plate adapter, the fastening arrangement comprising a threaded connection and a magnetic coupling between the fiber conduit plate and the conduit plate adapter.

The present invention has the advantage that, because of the pressure force centrally introduced via the fastening arrangement, the conduit plate adapter rests uniformly, i.e., without tilting, against the contact faces of the conduit plate, to assure that no damaging secondary air can penetrate into the spinning device between the fiber conduit plate and the conduit plate adapter. Additionally, problem-free and rapid exchange of the conduit plate adapter is nevertheless possible if required. The magnetic coupling on the conduit plate adapter in this case further assures that the conduit plate adapter remains exactly fixed in the predetermined installed position during operation. The provision of a threaded form of interlocking fastening device assisted by the magnetic coupling results in the very secure disposition of the conduit plate adapter during operation, which can still be quickly released without problems when required.

In a preferred embodiment, the threaded connection comprises a helically grooved shoulder disposed centrally on the fiber conduit plate and guide projections on the conduit plate adapter to compatibly engage in the helical grooves of the shoulder. In one variant of this embodiment, the fiber conduit plate comprises a rearward opening and a rear closure disk fitted sealably into the opening, and the shoulder of the threaded connection is fitted into the rear closure disk of the fiber conduit plate. Alternatively, the fiber conduit plate may be formed as a one-piece molded element and the shoulder of the threaded connection is formed integrally with the fiber conduit plate. In both cases the receptacle area of the fiber conduit plate which receives the conduit plate adapter is dependably sealed toward the rear, i.e., the fiber conduit plate has no connection with the atmosphere except for the opening for the yarn draw-off tube.

During the assembly of the spinning device, guide projections formed on the conduit plate adapter engage the grooves of the central shoulder of the fiber conduit plate, so that in the course of being rotated inward the conduit plate adapter is pressed uniformly into contact with the fiber conduit plate by the effects of a centrally acting axial force. The preferred embodiment of a threaded connection in this case results in a rapid and permanent fixation of the components with respect to one another.

According to another feature of the invention, the magnetic coupling preferably comprises an annular ferromagnetic disk fixed on the conduit plate adapter, with the guide projections being formed on the ferromagnetic disk for engagement with the grooves of the shoulder on the fiber conduit plate. This embodiment has the particular advantage that the annular contact surface of the conduit plate adapter comes into secure contact with the corresponding contact surface of the receptacle area of the fiber conduit plate to assure a sufficiently exactly fitted, axial installed position of the conduit plate adapter.

A rotationally correct installed position of the conduit plate adapter may be assured by the advantageous provision of a positioning device disposed between the fiber conduit plate and the conduit plate adapter for determining the rotational positioning of the conduit plate adapter relative to the fiber conduit plate, together with the formation of markings on the fiber conduit plate and on the conduit plate adapter for alignment of the markings to represent correct relative orientation thereof. The positioning device, which preferably comprises a centering pin and a curved groove, constitutes a simple but effective positioning device in this case, wherein the maintenance of the prescribed angular position of the conduit plate adapter relative to the fiber conduit plate can be monitored by means of an easily visible control device.

In a preferred embodiment, the magnetic coupling comprises one or more permanent magnets fixed on the fiber conduit plate and a compatible ferromagnetic component, e.g., in the form of a disk, fastened on the conduit plate adapter. Thus, for example, two symmetrically disposed disk-shaped permanent magnets or one centrally disposed ring magnet may be fixedly fastened to the fiber conduit plate or to a component connected with the fiber conduit plate. The associated ferromagnetic component, for example a steel ring or two correspondingly symmetrically disposed steel disks, is positioned on the conduit plate adapter such that, in the installed state, the permanent magnets and the ferromagnetic components are located opposite each other while maintaining a narrow air gap. This air gap assures an exactly fitted axial installed position of the conduit plate adapter, since it is assured that the conduit plate adapter is always seated in the area of its contact face.

Further details of the invention will be understood from the exemplary embodiments represented below by means of the drawings.

DETAILED DESCRIPTION OF THE PREFERRED EMBODIMENTS

Figure 1:
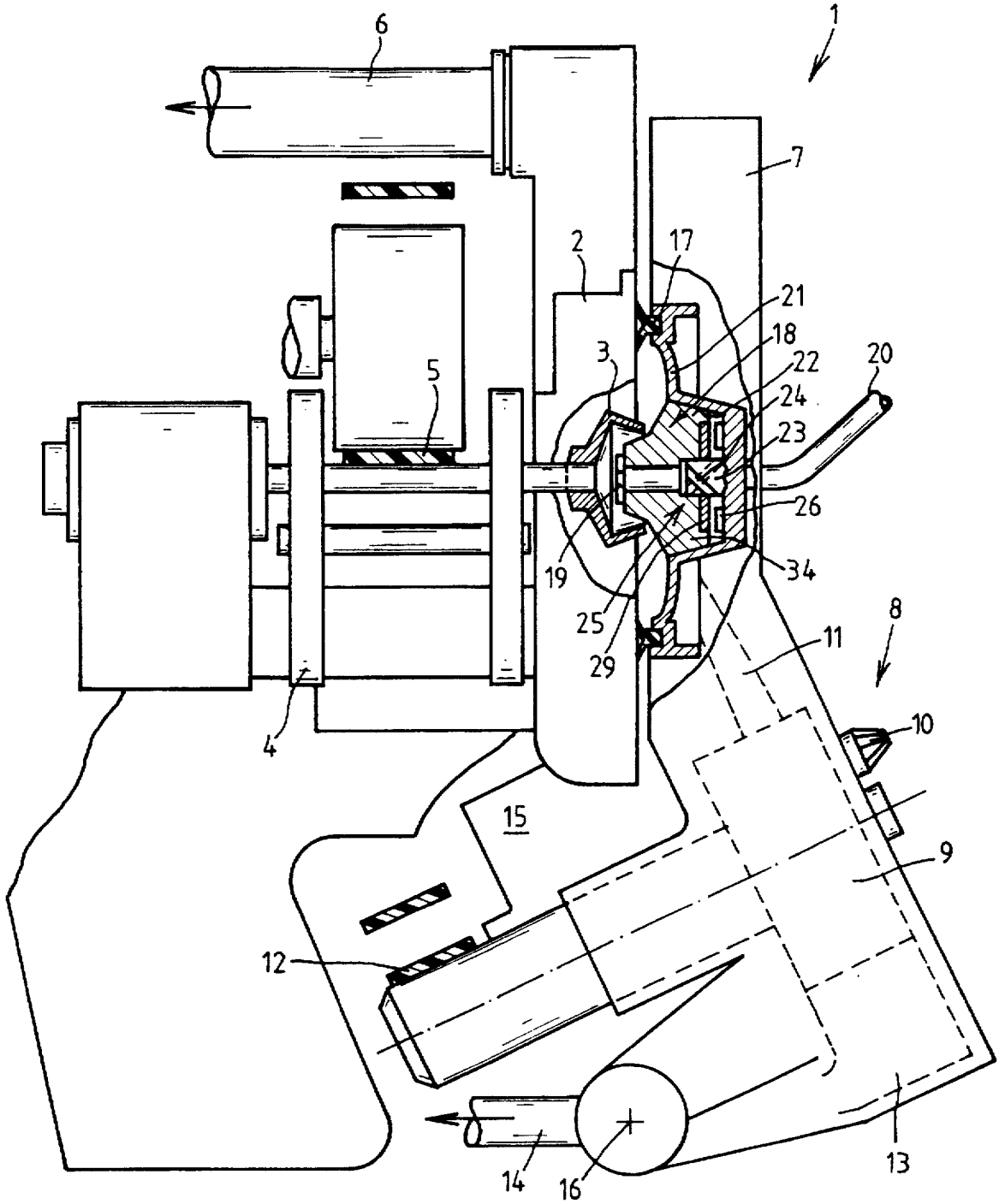
FIG. 1 is a schematic side elevational view of an open-end spinning device, in partial cross-section, according to the present invention.

Referring now to the accompanying drawings and initially to FIG. 1, an open-end spinning device is indicated generally at 1 with a conventional form of rotor housing 2 in which a spinning rotor 3 is disposed for high speed rotation on a drive shaft supported by a disk bearing 4 and driven by a tangential belt 5. The rotor housing 2 is open at its forward side but, during operation, is closed at the forward side by a fiber conduit plate 21 of a cover element 7 which is pivotable toward and away from the forward side of the housing 2 around a pivot axis 16. In this case, the fiber conduit plate 21 either is directly integrated into the cover element 7 or, preferably, is fastened on the cover element 7 as a separable component. The rotor housing 2 is connected with a suction device 6 which applies a vacuum force to the area enclosed by the fiber conduit plate 21 during such operation.

The cover element 7 incorporates a sliver draw-in device, generally indicated at 8, having an opening cylinder 9, a sliver draw-in cylinder 10 (not shown in detail), and a portion of a fiber guide conduit 11 extending toward the fiber conduit plate 21. The opening cylinder 9 is preferably driven by means of a tangential belt 12, with driving of the sliver draw-in roller 10 being accomplished either via a drive shaft (not represented) extending over the length of the entire open-end spinning machine, or via a separate electrical drive 15. In addition, the cover element 7 contains a dirt chamber 13 located underneath the opening cylinder 9, from which dirt and debris separated during the fiber opening operation of the opening cylinder 9 is removed by means of a suction device 14.

The fiber conduit plate 21 has an annular shoulder ring for supporting a lip sealing element 17. A receptacle area 33 is defined centrally within the fiber conduit plate 21 and opens in the direction of the rotor housing 2, the receptacle area 33 having a lateral contact face 22 which is formed in this embodiment in a frusto-conical shape.

A conduit plate adapter 18 formed with a correspondingly frusto-conically shaped bearing body 34 is releasably fastened in the receptacle 33 for easy removability. As is known, the conduit plate adapter 18 is formed with an axial central bore for receiving a yarn draw-off nozzle 19 the outward end of which adjoins a small yarn draw-off tube 20 in the yarn draw-off direction for withdrawal of yarn from the spinning rotor 3. The conduit plate adapter 18 is also formed in a known manner with a conduit portion 11 which communicates with the fiber guide conduit 11 of the sliver draw-in device 8 to deliver opened fibers into the spinning rotor 3 (see FIG. 4).

Figure 2:
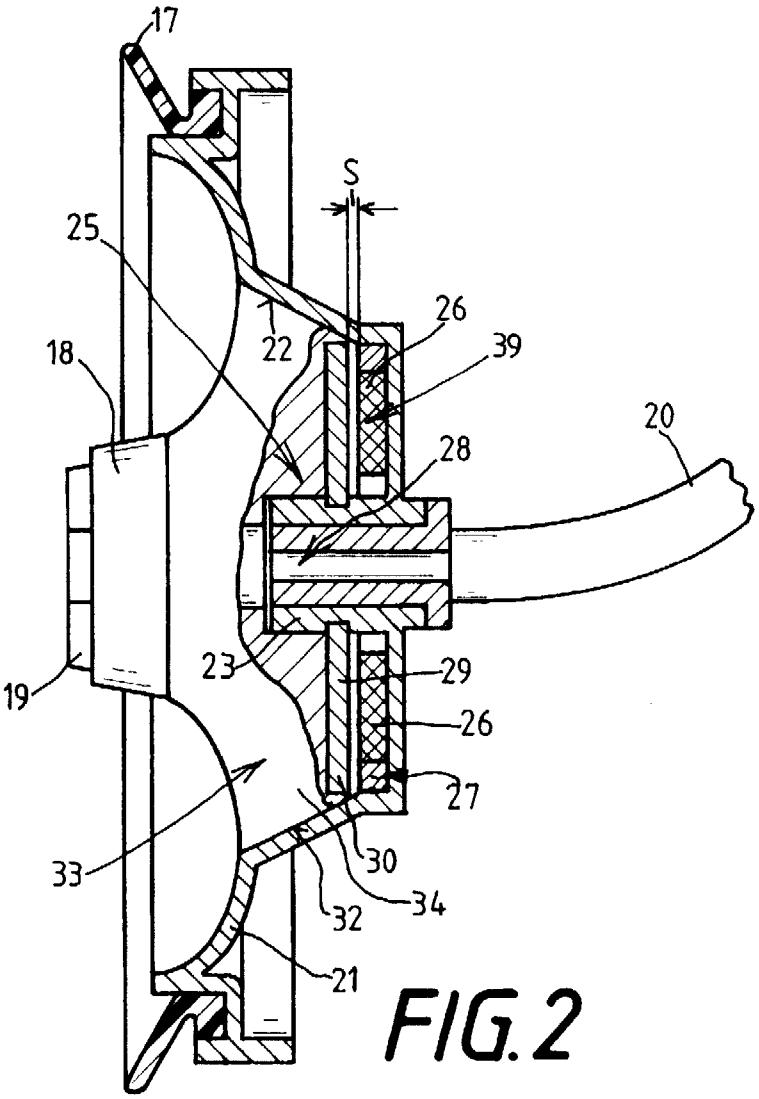
FIG. 2 is an enlarged side elevational view, in partial cross-section, of a releasable conduit plate adapter fastening arrangement in accordance with a first embodiment of the invention.

The fiber conduit plate 21 is preferably produced as an injection molded element and, as indicated in FIG. 1 and represented on a larger scale in FIG. 2, is formed with a centered axially projecting shoulder 23 which extends into the receptacle area 33 in the direction toward the spinning rotor 3. Spiral grooves 24 are cast or cut into this shoulder 23 (see FIG. 1).

In the embodiments of FIGS. 1 and 2, permanent magnets 26 are arranged within the bottom of the receptacle area 33 on the base of the fiber conduit plate 21, the magnets being either directly inserted into the injection molding of the fiber conduit plate 21 or positioned by means of a seating disk 27 fixed in place within the receptacle area 33.

The conduit plate adapter 18 is made, for example, of aluminum or plastic. On its rearward side opposite the yarn draw-off nozzle 19, the conduit plate adapter 18 is formed with a central axial depression 28 surrounded by a connecting means 29 preferably formed in this embodiment as a ferromagnetic annular disk 30 which is firmly press-fitted into the rear face of the conduit plate adapter 18. The disk 30 has two radially inwardly extending guide projections 31. In the course of inserting the conduit plate adapter 18 into the receptacle area 33 of the fiber conduit plate 21 for assembly thereof, the guide projections 31 engage the grooves 24 in the shoulder 23 of the fiber conduit plate 21 disposed centrally in its receptacle area 33 and, upon subsequent rotation of the conduit plate adapter 18, the projections 31 follow the grooves 24 causing the conical contact face 32 of the conduit plate adapter 18 to be pulled into fixed disposition against the correspondingly designed conical contact face 22 of the receptacle area 33, thereby effectively forming a threaded connection between the conduit plate adapter 18 and the fiber conduit plate 21. The threaded connection can here also be embodied as a bayonet-like catch mechanism.

Figure 4:
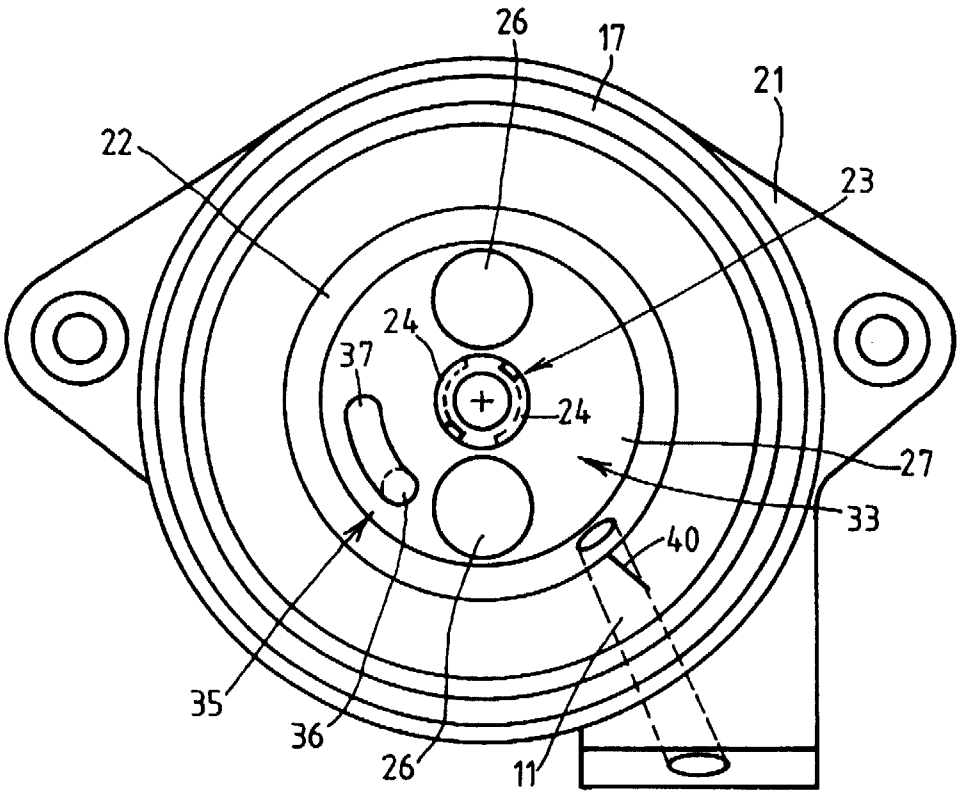
FIG. 4 is a front elevational view of the receptacle of the fiber conduit plate in accordance with embodiment of FIG. 3, with the conduit plate adapter removed.

The thusly installed position of the conduit plate adapter 18 can be easily adjusted rotationally to achieve the desired angularly correct disposition of the conduit plate adapter 18, for example, by means of a positioning device 35 shown in FIG. 4, consisting of a centering pin 36 embedded in the adapter 18 to engage in a curved groove 37 formed into the seating disk 27.

The correct installation can be easily checked by means of a control device consisting of a marker 40 on the fiber conduit plate 21 and a marker 41 on the conduit plate adapter 18 to indicate, when the markers 40, 41 are aligned, that the conduit plate adapter 18 is in its correct position.

An air gap S of 0.1 to 0.2 mm is provided in the installed state between the permanent magnets 26 at the base of the fiber conduit plate 21 and the ferromagnetic disk 30 seated on the facing rearward side of the conduit plate adapter 18, to exert a sufficient magnetic force to assure that the conduit plate adapter 18 always rests with the contact face 32 of its bearing body 34 against the corresponding contact face 22 of the receptacle 33 of the fiber conduit plate 21 and to maintain the conduit plate adapter 21 securely in this installed position during operation.

Figure 3:
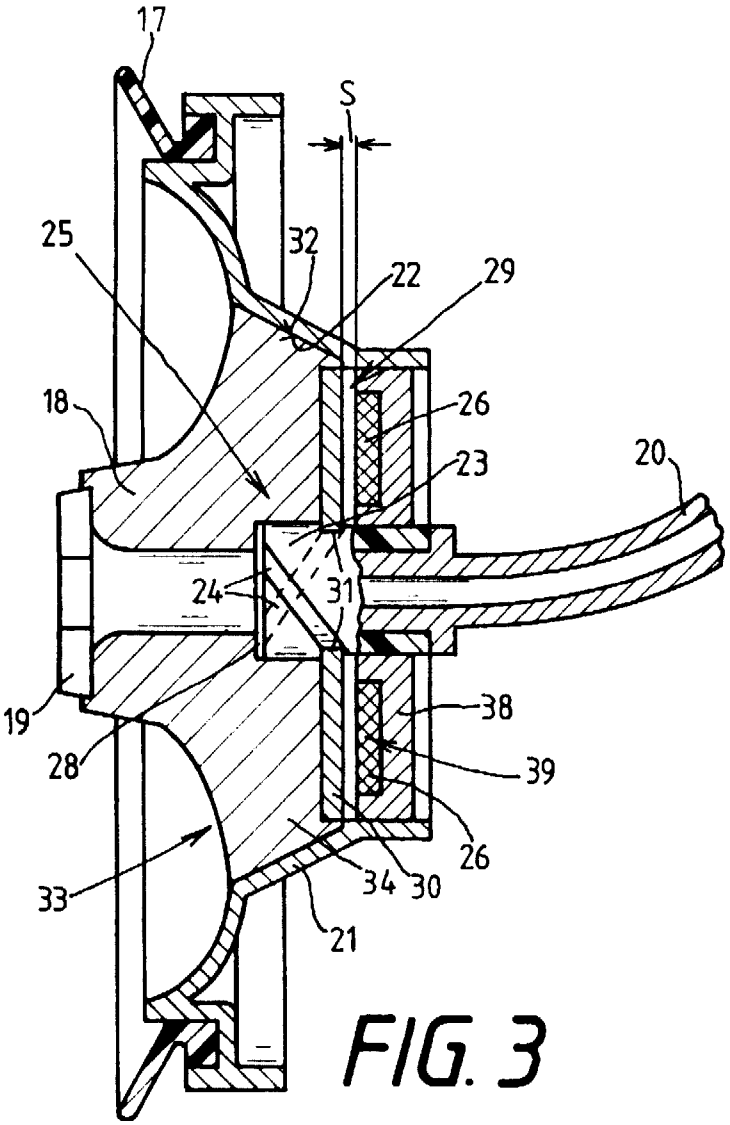
FIG. 3 is another enlarged side elevational view, in partial cross-section, of a releasable conduit plate adapter fastening arrangement in accordance with a second embodiment of the invention.
Figure 5:
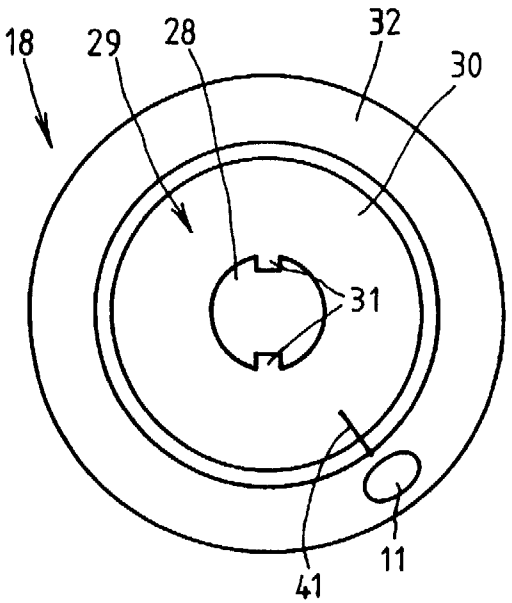
FIG. 5 is a rear elevational view of a conduit plate adapter according to the present invention.

The embodiment represented in FIG. 3 only differs in the structural design of the fiber conduit plate 21 from the previously described embodiments. As shown, the fiber conduit plate 21 is formed in this structural variant to be open toward its rearward side for production reasons, such opening being closed by a pressed-fitted rear closure disk 38. The permanent magnets 26 are fixed on or fitted into the rear closure disk 38 and act on the ferromagnetic disk 30 in the conduit plate adapter 18. The design of the threaded connection 25 corresponds to the design already described in connection with FIGS. 1 and 2.

As will be understood, the present invention is not limited to the exemplary embodiments shown. For example, it is easily conceivable to interchange the arrangement of the elements of the interlocking threaded fastening device 25 and the elements of the frictionally connected fastening means 39, e.g., the centered shoulder 23 can alternatively be disposed on the conduit plate adapter 18, and the ferromagnetic disk with its guide projections 31 on the fiber conduit plate 21. In this case the permanent magnets 26 would correspondingly be positioned in the conduit plate adapter 18.

The installation and removal of the conduit plate adapter 18 is preferably performed by means of a special tool, which could for example be threaded or otherwise engaged into bores (not represented) in the area of the yarn draw-off nozzle 19. By means of such a tool the conduit plate adapter can be easily released by simple turning from its installed position via the threaded connection.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning device comprising a rotor housing having a forward side, the housing defining a forward opening at the forward side thereof, a spinning rotor rotatably disposed in the forward opening of the rotor housing for driven rotation, a fiber conduit plate for closing the forward opening of the rotor housing, a conduit plate adapter having an opening for delivering fibers to the rotor and a nozzle for take-off of yarn from the rotor, and a fastening arrangement releasably affixing the conduit plate adapter to the fiber conduit plate for selective exchangability of the conduit plate adapter, the fastening arrangement comprising a threaded connection and a magnetic coupling between the fiber conduit plate and the conduit adapter.

2. The open-end spinning device in accordance with claim 1, wherein the threaded connection comprises a shoulder disposed on the fiber conduit plate, the shoulder having helical grooves, and guide projections on the conduit plate adapter to compatibly engage in the helical grooves of the shoulder.

3. The open-end spinning device in accordance with claim 2, wherein the fiber conduit plate comprises a rearward side facing away from the forward opening of the housing and has a rearward opening at the rearward side thereof, and a rear closure disk fitted sealably into the rearward opening, and the shoulder of the threaded connection is fitted into the rear closure disk of the fiber conduit plate.

4. The open-end spinning device in accordance with claim 2, wherein the fiber conduit plate is formed as a one-piece molded element and the shoulder of the threaded connection is formed integrally with the fiber conduit plate.

5. The open-end spinning device in accordance with claim 2, wherein the conduit plate adapter comprises a conical body having the yarn draw-off nozzle at one side thereof and a depression for receiving the shoulder of the threaded connection at the opposite side thereof.

6. The open-end spinning device in accordance with claim 2, wherein the magnetic coupling comprises an annular ferromagnetic disk fixed on the conduit plate adapter, the guide projections being formed on the ferromagnetic disk for engagement with the grooves of the shoulder on the fiber conduit plate.

7. The open-end spinning device in accordance with claim 1, and further comprising a positioning device disposed between the fiber conduit plate and the conduit plate adapter for rotational positioning of the conduit plate adapter relative to the fiber conduit plate.

8. The open-end spinning device in accordance with claim 1, wherein the magnetic coupling comprises a permanent magnet fixed to the fiber conduit plate and a ferromagnetic disk fixed to the conduit plate adapter.

9. The open-end spinning device in accordance with claim 8, wherein the fastening arrangement is adapted to establish an air gap (S) of at least about 0.1 mm between the ferromagnetic disk on the conduit plate adapter and the permanent magnet on the fiber conduit plate.

10. The open-end spinning device in accordance with claim 1, and further comprising a marking on the fiber conduit plate and a marking on the conduit plate adapter for alignment to represent correct relative orientation thereof.

* * * * *